US008463614B2

(12) United States Patent
Zhang et al.

(10) Patent No.: US 8,463,614 B2
(45) Date of Patent: Jun. 11, 2013

(54) AUDIO ENCODING/DECODING FOR REDUCING PRE-ECHO OF A TRANSIENT AS A FUNCTION OF BIT RATE

(75) Inventors: Benhao Zhang, Shanghai (CN); Heyun Huang, Shanghai (CN); Tan Li, Shanghai (CN); Fuhuei Lin, Shanghai (CN)

(73) Assignee: Spreadtrum Communications (Shanghai) Co., Ltd., Shanghai (CN)

( * ) Notice: Subject to any disclaimer, the term of this patent is extended or adjusted under 35 U.S.C. 154(b) by 694 days.

(21) Appl. No.: 12/615,965

(22) Filed: Nov. 10, 2009

(65) Prior Publication Data

US 2010/0121648 A1 May 13, 2010

Related U.S. Application Data

(63) Continuation of application No. PCT/CN2008/070987, filed on May 16, 2008.

(30) Foreign Application Priority Data

May 16, 2007 (CN) ..... 2007 1 0040710

(51) Int. Cl.
*G10L 19/02* (2006.01)
*G10L 21/02* (2006.01)

(52) U.S. Cl.
USPC ..... 704/500; 704/224; 704/225

(58) Field of Classification Search
USPC ..... 704/206, 211, 225, 226, 227, 500, 704/501, 224
See application file for complete search history.

(56) References Cited

U.S. PATENT DOCUMENTS

| | | | | |
|---|---|---|---|---|
| 5,388,181 | A | 2/1995 | Anderson et al. | |
| 5,699,382 | A * | 12/1997 | Shoham et al. | 375/243 |
| 5,886,276 | A * | 3/1999 | Levine et al. | 84/603 |
| 5,974,379 | A * | 10/1999 | Hatanaka et al. | 704/225 |
| 6,453,282 | B1 | 9/2002 | Hilpert et al. | |
| 6,704,705 | B1 * | 3/2004 | Kabal et al. | 704/230 |
| 7,269,554 | B2 * | 9/2007 | Lopez-Estrada et al. | 704/229 |
| 7,353,169 | B1 * | 4/2008 | Goodwin et al. | 704/224 |
| 7,469,209 | B2 * | 12/2008 | Chong-White et al. | 704/229 |

(Continued)

FOREIGN PATENT DOCUMENTS

| | | |
|---|---|---|
| CN | 1536559 | 10/2004 |
| CN | 1684371 | 10/2005 |

(Continued)

*Primary Examiner* — Martin Lerner
(74) *Attorney, Agent, or Firm* — Hamre, Schumann, Mueller & Larson, P.C.

(57) ABSTRACT

An audio encoding method and a corresponding decoding method are provided. Accordingly, the pre-echo effect of the audio transient signal is eliminated and the distortion of the transient signal is mitigated. The technical solution includes performing time-domain processing on an input audio transient signal; dividing sampling points $x_1, x_2, \ldots, x_N$ of an input frame into L segments; calculating an energy $E_i$ for each segment; calculating an average energy $E_0$ for each segment of the input frame; calculating a multiplying parameter $\lambda_i$ corresponding to each segment by virtue of $\lambda_i = r(\text{bitrate}) * E_0 / E_i$; multiplying the sampling points of all the segments of the input frame by corresponding multiplying parameter $\lambda_i$, obtaining the processed sampling points $x_1', x_2', \ldots, x_N'$; and sending the multiplying parameter $\lambda_i$ to a code stream for transportation; performing time-frequency transformation and coding on the processed sampling points $x_1', x_2', \ldots, x_N'$ and outputting to the code stream.

32 Claims, 5 Drawing Sheets

U.S. PATENT DOCUMENTS

| | | | | |
|---|---|---|---|---|
| 7,921,008 | B2 * | 4/2011 | Huang et al. | 704/210 |
| 8,032,363 | B2 * | 10/2011 | Chen et al. | 704/225 |
| 8,175,866 | B2 * | 5/2012 | Huang et al. | 704/207 |
| 2004/0181403 | A1 | 9/2004 | Hsu | |
| 2004/0230425 | A1 * | 11/2004 | Yu et al. | 704/223 |
| 2005/0027526 | A1 * | 2/2005 | Erell et al. | 704/237 |
| 2005/0192799 | A1 | 9/2005 | Kim et al. | |
| 2005/0228648 | A1 * | 10/2005 | Heikkinen | 704/205 |
| 2006/0122825 | A1 | 6/2006 | Oh et al. | |
| 2006/0293884 | A1 * | 12/2006 | Grill et al. | 704/219 |
| 2007/0036360 | A1 | 2/2007 | Breebaart | |
| 2007/0067166 | A1 * | 3/2007 | Pan et al. | 704/222 |
| 2007/0081597 | A1 * | 4/2007 | Disch et al. | 375/242 |
| 2008/0133226 | A1 * | 6/2008 | Huang et al. | 704/219 |
| 2008/0228474 | A1 * | 9/2008 | Huang et al. | 704/226 |
| 2010/0023325 | A1 * | 1/2010 | Bessette et al. | 704/219 |

FOREIGN PATENT DOCUMENTS

| | | |
|---|---|---|
| CN | 1787383 | 6/2006 |
| CN | 1860526 | 11/2006 |
| JP | 2000059232 | 2/2000 |

* cited by examiner

AUDIO ENCODING/DECODING FOR REDUCING PRE-ECHO OF A TRANSIENT AS A FUNCTION OF BIT RATE

FIELD OF THE INVENTION

The present invention relates to encoding/decoding method and apparatus thereof, and more specifically, to audio encoding/decoding method and apparatus thereof.

BACKGROUND

A transient signal is a special audio signal, which often exists in an audio sequence produced by musical instruments including a percussion instrument. For instance, a signal produced by continuously striking the percussion instrument may be referred to as a transient signal. Such signal is characterized in that if the signal is encoded by a conventional transformation, such as Modified Discrete Cosine Transformation (MDCT), a pre-echo effect may occur due to the presence of the quantization noise. The pre-echo effect is caused by the quantization noise due to insufficient number of quantization bits. The quantization noise is distributed evenly into the whole time domain. The signal before the appearance of the transient signal may be occupied by the quantization noise and thus causing the pre-echo effect. Pre-echo effect is an audio distortion which human ears can hardly bear. Thus, there is a need for a special method for encoding or decoding a transient signal.

Two conventional techniques are available to process such transient signal. One is to switch between long and short windows, while the other is to perform noise rectification in a time domain. The switching between long and short windows requires a large amount of computational overhead and caches. The method of noise rectification in time domain rectifies the distribution of the quantization noise in time domain based on the result of self-adaptive estimation in frequency domain. This method is relatively simple, but may result in some distortions since the time-domain envelope is not extracted thoroughly.

SUMMARY

The present invention is aimed at addressing the above question and therefore provides an audio encoding method and a corresponding decoding method. Accordingly, the pre-echo effect of the audio transient signal can be eliminated and the distortion of the transient signal can be mitigated.

According to the present invention, an audio encoding apparatus and a corresponding decoding apparatus are provided. Accordingly, the pre-echo effect of the audio transient signal can be eliminated and the distortion of the transient signal can be mitigated.

An audio encoding method for encoding a transient signal is provided according to the present invention. The method includes:

performing time-domain processing on an input audio transient signal and obtaining a new time-domain signal;

dividing sampling points $x_1, x_2, \ldots, x_N$ of an input frame into L segments, where N is the length of the input frame and L is an arbitrary natural number less than or equal to N;

calculating an energy $E_i$ for each segment, where i is a natural number between 1~L;

calculating an average energy $E_0$ for each segment of the input frame;

calculating a multiplying parameter $\lambda_i$ corresponding to each segment by virtue of $\lambda_i = r(\text{bitrate}) * E_0/E_i$, where i is a natural number between 1~L and r(bitrate) is a bit rate related function;

multiplying the sampling points of all the segments of the input frame by corresponding multiplying parameter $\lambda_i$, obtaining the processed sampling points $x_1', x_2', \ldots, x_N'$; and sending the multiplying parameter $\lambda_i$ to a code stream for transportation;

performing time-frequency transformation and coding on the processed sampling points $x_1', x_2', \ldots, x_N'$ and outputting to the code stream.

In the above audio encoding method, the sampling points $x_1, x_2, \ldots, x_N$ of the input frame are divided evenly into 32 segments.

In the above audio encoding method, the sampling points $x_1, x_2, \ldots, x_N$ of the input frame are divided evenly into 16 segments.

In the above audio encoding method, the sampling points $x_1, x_2, \ldots, x_N$ of the input frame are divided into a plurality of even or uneven segments according to a position where transient effect takes place.

In the above audio encoding method, the formula for calculating the energy of each segment is $$E_i = \sum_{n \in A_i} x_n^2,$$

where $A_i$ indicates a segment of the input frame.

In the audio encoding method, the formula for calculating the average energy of the current input frame is $$E_0 = \frac{1}{L} \sum_{i=1}^{L} E_i.$$

In the above audio encoding method, bit rate BR in the bit rate related function r(bitrate) is a variable, wherein the variable BR refers to an average bit rate of an audio channel; when BR<35 k, the value of function is 15.0; when 35 k<BR<37.5 k, the value of function is 10.0; when 37.5 k≦BR<40 k, the value of function is 8.5; when 40 k≦BR<42.5 k, the value of function is 7.0; when 42.5 k≦BR<45 k, the value of function is 6.0; when 45 k≦BR<47.5 k, the value of function is 4.8; when 47.5 k≦BR<50 k, the value of function is 3.9; when 50 k≦BR<52.5 k, the value of function is 3.6; when 52.5 k≦BR<55 k, the value of function is 3.4; when 55 k≦BR<57.5 k, the value of function is 2.2; when 57.5 k≦BR<60 k, the value of function is 1.5; when 60 k≦BR<62.5 k, the value of function is 1.2; when BR≧62.5 k, the value of function is 1.1.

An audio encoding method for encoding a transient signal is provided according to the present invention. The method includes:

performing time-domain processing on an input audio transient signal;

dividing sampling points $x_1, x_2, \ldots, x_N$ of an input frame into L segments, where N is the length of the input frame and L is an arbitrary natural number less than or equal to N;

calculating an energy $E_i$ for each segment, where i is a natural number between 1~L;

calculating an average energy $E_0$ for each segment of the input frame;

for each segment of the input frame, comparing the product of a bit related function r and $E_0/E_i$ with a threshold T;

for segment $A_i$ for which the product is less than the threshold T, multiplying the sampling points of the segment with the multiplying parameter $\lambda_i$, where $\lambda_i$=r(bitrate)*$E_0/E_i$;

transporting these multiplying parameters to the code stream and obtaining the processed sampling points $x_1'$, $x_2'$, . . . , $x_N'$;

performing time-frequency transformation and coding on the processed sampling points $x_1'$,$x_2'$, . . . , $x_N'$ and outputting to the code stream.

In the above audio encoding method, the sampling points $x_1$,$x_2$, . . . , $x_N$ of the input frame are divided evenly into 32 segments.

In the above audio encoding method, the sampling points $x_1$,$x_2$, . . . , $x_N$ of the input frame are divided evenly into 16 segments.

In the above audio encoding method, the sampling points $x_1$,$x_2$, . . . , $x_N$ of the input frame are divided into a plurality of even or uneven segments according to a position where transient effect takes place.

In the above audio encoding method, the formula for calculating the energy for each segment is $$E_i = \sum_{n \in A_i} x_n^2,$$

where $A_i$ indicates a segment of the input frame.

In the above audio encoding method, the formula for calculating the average energy for each segment of the input frame is $$E_0 = \frac{1}{L}\sum_{i=1}^{L} E_i.$$

In the above audio encoding method, the threshold T is predetermined.

In the above audio encoding method, bit rate BR in the bit rate related function r(bitrate) is a variable, wherein the variable BR refers to an average bit rate of an audio channel; when BR<35 k, the value of function is 15.0; when 35 k≦BR<37.5 k, the value of function is 10.0; when 37.5 k≦BR<40 k, the value of function is 8.5; when 40 k≦BR<42.5 k, the value of function is 7.0; when 42.5 k≦BR<45 k, the value of function is 6.0; when 45 k≦BR<47.5 k, the value of function is 4.8; when 47.5 k≦BR<50 k, the value of function is 3.9; when 50 k≦BR<52.5 k, the value of function is 3.6; when 52.5 k≦BR<55 k, the value of function is 3.4; when 55 k≦BR<57.5 k, the value of function is 2.2; when 57.5 k≦BR<60 k, the value of function is 1.5; when 60 k≦BR<62.5 k, the value of function is 1.2; when BR≧62.5 k, the value of function is 1.1.

An audio decoding method for decoding a transient signal is provided according to the present invention. The method includes:

performing frequency-time transformation on the code stream and the obtaining processed sampling points $x_1'$, $x_2'$, . . . , $x_N'$;

obtaining a multiplying parameter $\lambda_i$ from the code stream;

dividing each of the sampling points $x_1'$,$x_2'$, . . . , $x_N'$ by its corresponding multiplying parameters $\lambda_i$ and obtaining original sampling points $x_1$,$x_2$, . . . , $x_N$;

performing time-domain processing and synthesizing a time-domain signal.

Based on the above method, an audio encoding apparatus for encoding a transient signal is also provided according to the present invention. The apparatus includes:

a time-domain processing module, configured to perform time-domain processing on an input audio transient signal and obtain a new time-domain signal;

a dividing module, configured to divide sampling points $x_1$,$x_2$, . . . , $x_N$ of an input frame into L segments, where N is the length of the input frame and L is an arbitrary natural number less than or equal to N;

a segment energy calculating module, configured to calculate an energy $E_i$ for each segment, where i is a natural number between 1~L;

a module for calculating average energy of an input frame, configured to calculate an average energy $E_0$ for each segment of the input frame;

a multiplying parameter calculating module, configured to calculate a multiplying parameter $\lambda_i$ corresponding to each segment by virtue of $\lambda_i$=r(bitrate)*$E_0/E_i$, where i is a natural number between 1~L and r(bitrate) is a bit rate related function;

a scaling module, configured to multiply the sampling points of all the segments of the input frame by a corresponding multiplying parameter $\lambda_i$ and obtain processed sampling points $x_1'$,$x_2'$, . . . , $x_N'$;

a multiplying parameter transport module, configured to send the multiplying parameters $\lambda_i$ to a code stream for transportation;

a time-frequency transformation and coding module, configured to perform time-frequency transformation and coding on the processed sampling points $x_1'$,$x_2'$, . . . , $x_N'$ and output to the code stream.

In the above audio encoding apparatus, the dividing module evenly divides the sampling points $x_1$,$x_2$, . . . , $x_N$ of the input frame into 32 segments.

In the above audio encoding apparatus, the dividing module evenly divides the sampling points $x_1$,$x_2$, . . . , $x_N$ of the input frame into 16 segments.

In the above audio encoding apparatus, the dividing module divides the sampling points $x_1$,$x_2$, . . . , $x_N$ of the input frame into a plurality of even or uneven segments according to a position where transient effect takes place.

In the above audio encoding apparatus, the segment energy calculating module calculates the energy for each segment using a formula $$E_i = \sum_{n \in A_i} x_n^2,$$

where $A_i$ indicates a segment of the input frame.

In the above audio encoding apparatus, the module for calculating average energy of an input frame calculates the average energy of an input frame using a formula $$E_0 = \frac{1}{L}\sum_{i=1}^{L} E_i.$$

In the above audio encoding apparatus, bit rate BR in the bit rate related function r(bitrate) is a variable, wherein the variable BR refers to an average bit rate of an audio channel; when BR<35 k, the value of function is 15.0; when 35 k≦BR<37.5 k, the value of function is 10.0; when 37.5 k≦BR<40 k, the value of function is 8.5; when 40 k≦BR<42.5 k, the value of function is 7.0; when 42.5 k≦BR<45 k, the value of function is 6.0; when 45 k≦BR<47.5 k, the value of function is 4.8; when 47.5 k≦BR<50 k, the value of function is 3.9; when 50 k≦BR<52.5 k, the value of function is 3.6; when 52.5 k≦BR<55 k, the value of function is 3.4; when 55 k≦BR<57.5 k, the value of function is 2.2; when 57.5 k≦BR<60 k, the value of function is 1.5; when 60 k≦BR<62.5 k, the value of function is 1.2; when BR≧62.5 k, the value of function is 1.1.

An audio encoding apparatus for encoding a transient signal is provided according to the present invention. The method includes:

a time-domain processing module, configured to perform time-domain processing on an input audio transient signal and obtain a new time-domain signal;

a dividing module, configured to divide sampling points $x_1, x_2, \ldots, x_N$ of an input frame into L segments, where N is the length of the input frame and L is an arbitrary natural number less than or equal to N;

a segment energy calculating module, configured to calculate an energy $E_i$ for each segment, where i is a natural number between 1~L;

a module for calculating average energy of an input frame, configured to calculate an average energy $E_0$ for each segment of the input frame;

a multiplying parameter calculating module, configured to calculate a multiplying parameter $\lambda_i$ corresponding to each segment by virtue of $\lambda_i$=r(bitrate)*$E_0/E_i$, where i is a natural number between 1~L and r(bitrate) is a bit rate related function;

a determination module, configured to compare a product of the bit related function r and $E_0/E_i$ with a threshold T;

a scaling module, configured to multiply sampling points of a segment $A_i$ for which the product is less than the threshold T by a corresponding multiplying parameter $\lambda_i$ and obtain processed sampling points $x_i', x_2', \ldots, x_N'$;

a multiplying parameter transport module, configured to transport the multiplying parameters $\lambda_i$ to a code stream;

a time-frequency transformation and coding module, configured to perform time-frequency transformation and coding on the processed sampling points $x_1', x_2', \ldots, x_N'$ and output to the code stream.

In the above audio encoding apparatus, the dividing module evenly divides the sampling points $x_1, x_2, \ldots, x_N$ of the input frame into 32 segments.

In the above audio encoding apparatus, the dividing module evenly divides the sampling points $x_1, x_2, \ldots, x_N$ of the input frame into 16 segments.

In the above audio encoding apparatus, the dividing module divides the sampling points $x_1, x_2, \ldots, x_N$ of the input frame into a plurality of even or uneven segments according to a position where transient effect takes place.

In the above audio encoding apparatus, the segment energy calculating module calculates the energy for each segment using a formula $$E_i = \sum_{n \in A_i} x_n^2,$$

where $A_i$ indicates a segment of the input frame.

In the above audio encoding apparatus, the module for calculating average energy of an input frame calculates the average energy of an input frame using a formula $$E_0 = \frac{1}{L}\sum_{i=1}^{L} E_i.$$

In the above audio encoding apparatus, the threshold T for the determination module is predetermined.

In the above audio encoding apparatus, bit rate BR in the bit rate related function r(bitrate) is a variable, wherein the variable BR refers to an average bit rate of an audio channel; when BR<35 k, the value of function is 15.0; when 35 k≦BR<37.5 k, the value of function is 10.0; when 37.5 k≦BR<40 k, the value of function is 8.5; when 40 k≦BR<42.5 k, the value of function is 7.0; when 42.5 k≦BR<45 k, the value of function is 6.0; when 45 k≦BR<47.5 k, the value of function is 4.8; when 47.5 k≦BR<50 k, the value of function is 3.9; when 50 k≦BR<52.5 k, the value of function is 3.6; when 52.5 k≦BR<55 k, the value of function is 3.4; when 55 k≦BR<57.5 k, the value of function is 2.2; when 57.5 k≦BR<60 k, the value of function is 1.5; when 60 k≦BR<62.5 k, the value of function is 1.2; when BR≧62.5 k, the value of function is 1.1.

An audio decoding apparatus for decoding a transient signal is provided according to the present invention. The apparatus includes:

a frequency-time transformation module, configured to perform a frequency-time transformation on a code stream to obtain processed sampling points $x_1', x_2', \ldots, x_N'$;

a multiplying parameter obtaining module, configured to obtain a multiplying parameter $\lambda_i$ from the code stream;

an anti-scaling module, configured to divide each of the sampling points $x_1', x_2', \ldots, x_N'$ by its corresponding multiplying parameters $\lambda_i$ and obtain the original sampling points $x_1, x_2, \ldots, x_N$;

a time-domain processing module, configured to perform time-domain processing on the sampling points and synthesize a time-domain signal.

Compared with the prior arts, the present invention enjoys the following advantages. By performing a scaling process on the time-domain sampling points of the input frame before the transient signal is transformed and encoded at the encoding end and by performing an anti-scaling process on the signal to recover the original signal at the decoding end, the present invention succeeds in eliminating the pre-echo effect of the audio transient signal and thus mitigating the distortion of the transient signal.

PREFERRED EMBODIMENT OF THE PRESENT INVENTION

Detailed description will be made to the present invention in conjunction with the embodiments and the accompanying drawings.

Figure 1:
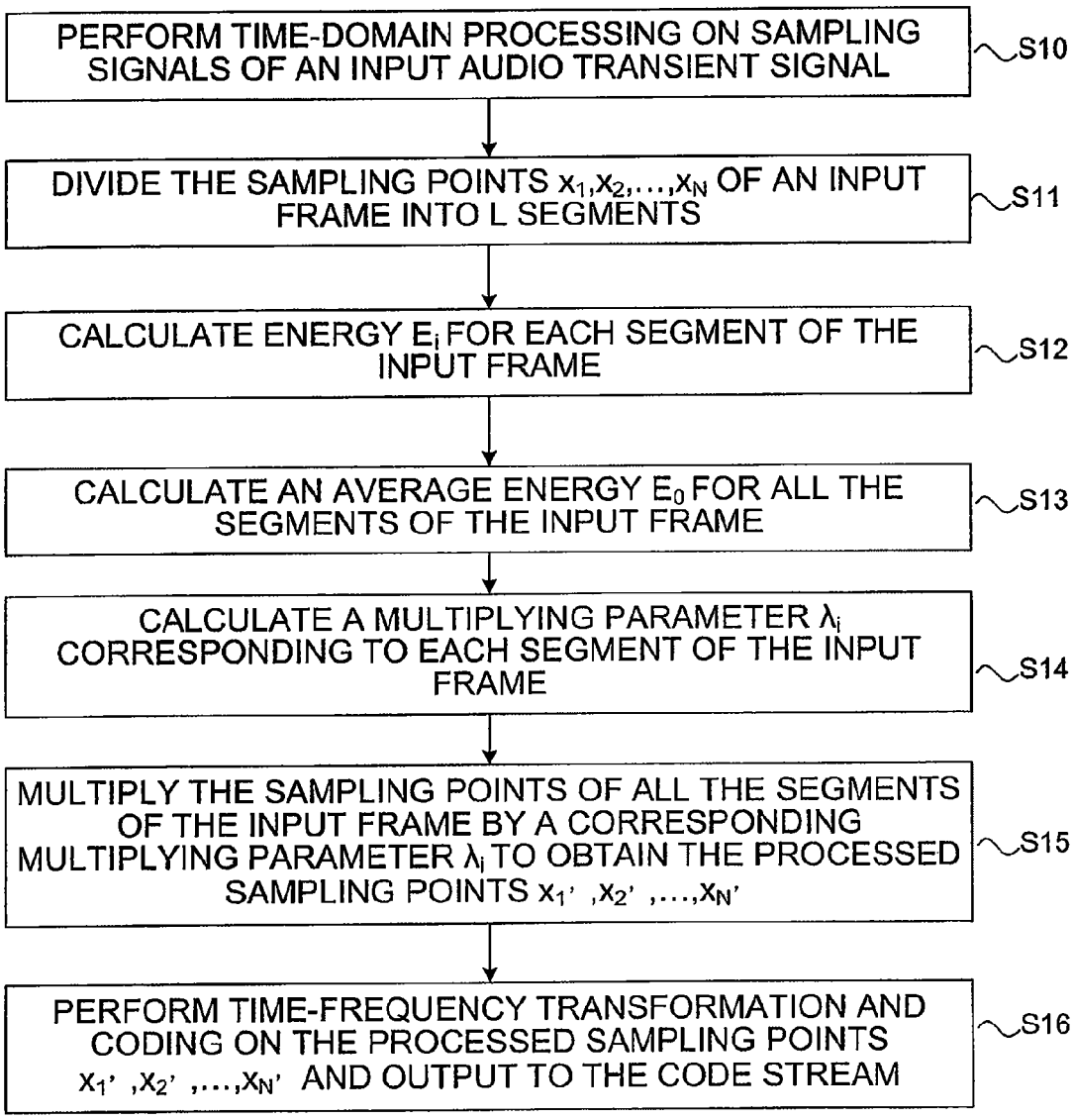
FIG. 1 is a flow diagram of an audio encoding method according to a preferred embodiment of the present invention.

FIG. 1 is a flow diagram of an audio encoding method according to a preferred embodiment of the present invention. Detailed description is made below to each step in the method with reference to FIG. 1.

At step S10, an input audio transient signal is processed in time domain and a new time-domain signal is thus obtained. This is a traditional signal processing step, including designing filter sets, controlling gain, selecting long and short windows, etc.

At step S11, sampling points $x_1, x_2, \ldots, x_N$ of an input frame are divided into L segments, where N is the length of the input frame and L is an arbitrary natural number less than or equal to N. These sampling points $x_1, x_2, \ldots, x_N$ are divided into $$\{x_{l_0}, x_{l_0+1}, \ldots, x_{l_1}\}, \{x_{l_1+1}, x_{l_1+2}, \ldots, x_{l_2}\}, \ldots, \{x_{l_{L-1}+1}, x_{l_{L-1}+2}, \ldots, x_{l_L}\},$$

where $l_0=1, l_L=N$.

There are various methods for segmentation. All sampling points can be evenly divided into 32 segments. Alternatively, all sampling points can be evenly divided into 16 segments. Or, all the sampling points can be divided into several even or uneven segments.

At step S12, the energy $E_i$ for each segment of the input frame is calculated, where i is a natural number between 1~L. The calculation formula is given by $$E_i = \sum_{n \in A_i} x_n^2,$$

where $A_i$ indicates a segment in the input frame.

At step S13, an average energy $E_0$ for each segment of the current input frame is computed. The calculation formula is $$E_0 = \frac{1}{L}\sum_{i=1}^{L} E_i.$$

At step S14, the multiplying parameter $\lambda_i$ corresponding to each segment of the input frame is calculated by formula $\lambda_i = r(\text{bitrate}) * E_0/E_i$, where i is a natural number between 1~L.

The function r(bitrate) herein is a bit rate related function. Its self variable BR refers to bit rate, indicating the bit rate of a channel. For instance, there are currently two channels and the total bit rate is 120 k, then the self variable BR is 120 K/2=60 k. The function is detailed in the below table.

| Self variable BR (bit rate of a channel) | value r of the function |
|---|---|
| BR < 35k | 15.0 |
| 35k ≦ BR < 37.5k | 10.0 |
| 37.5k ≦ BR < 40k | 8.5 |

-continued

| Self variable BR (bit rate of a channel) | value r of the function |
|---|---|
| 40k ≦ BR < 42.5k | 7.0 |
| 42.5k ≦ BR < 45k | 6.0 |
| 45k ≦ BR < 47.5k | 4.8 |
| 47.5k ≦ BR < 50k | 3.9 |
| 50k ≦ BR < 52.5k | 3.6 |
| 52.5k ≦ BR < 55k | 3.4 |
| 55k ≦ BR < 57.5k | 2.2 |
| 57.5k ≦ BR < 60k | 1.5 |
| 60k ≦ BR < 62.5k | 1.2 |
| BR ≧ 62.5k | 1.1 |

At step S15, the sampling points of all the segments of the input frame are multiplied by the multiplying parameter $\lambda_i$ so that processed sampling points $x_1', x_2', \ldots, x_N'$ are obtained. At the same time, these multiplying parameters $\lambda_i$ are transported into a code stream. The scaling formula is given by $x_n' = x_n \lambda_i, x_n \in \{x_{l_{i-1}+1}, x_{l_{i-1}+2}, \ldots, x_{l_i}\}$.

At step S16, the processed sampling points $x_1', x_2', \ldots, x_N'$ are output to the code stream after time-frequency transformation and coding.

Figure 4:
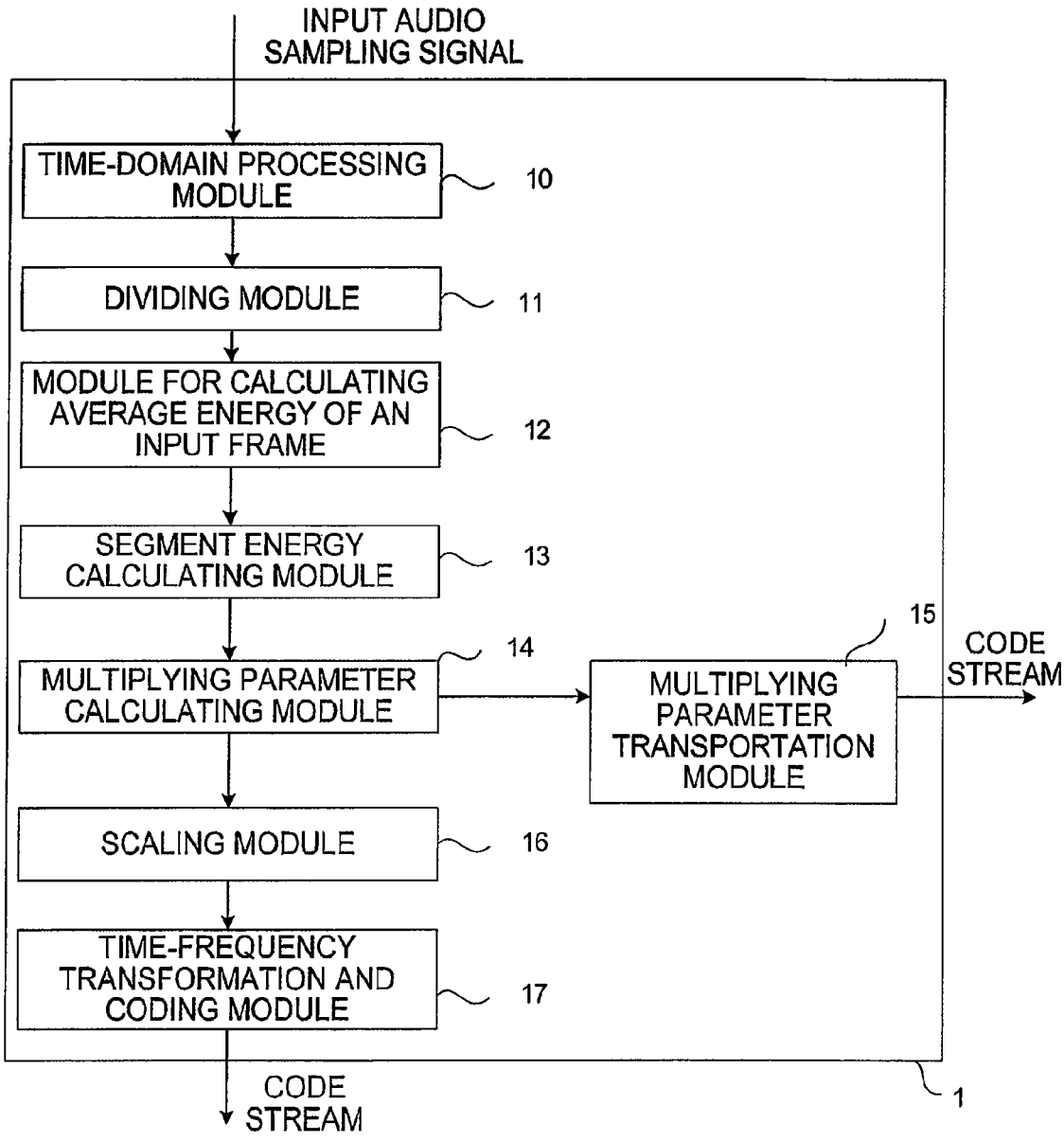
FIG. 4 is a block diagram of an audio encoding apparatus according to a preferred embodiment of the present invention.

Based on the above method, an audio encoding apparatus is also provided according to the present invention, as illustrated in FIG. 4. The audio encoding apparatus 1 includes a time-domain processing module 10, a dividing module 11, a module for calculating average energy of an input frame 12, a segment energy calculating module 13, a multiplying parameter calculating module 14, a multiplying parameter transportation module 15, a scaling module 16 and a time-frequency transformation and coding module 17.

The time-domain processing module 10 processes the input audio transient signal in time domain and obtains a new time-domain signal. The time-domain processing module 10 includes traditional filter sets, a gain control module, a long-and-short window selecting module, etc. The dividing module 11 divides sampling points $x_1, x_2, \ldots, x_N$ of an input frame into L segments, where N is the length of the input frame and L is an arbitrary natural number less than or equal to N. These sampling points $x_1, x_2, \ldots, x_N$ are divided into $$\{x_{l_0}, x_{l_0+1}, \ldots, x_{l_1}\}, \{x_{l_1+1}, x_{l_1+2}, \ldots, x_{l_2}\}, \ldots, \{x_{l_{L-1}+1}, x_{l_{L-1}+2}, \ldots, x_{l_L}\},$$

where $l_0=1, l_L=N$. There are various methods for segmentation. All sampling points can be evenly divided into 32 segments. Alternatively, all sampling points can be evenly divided into 16 segments. Or, all the sampling points can be divided into several even or uneven segments according to the position where transient effect takes place.

The segment energy calculating module 13 calculates the energy $E_i$ for each segment of the input frame, where i is a natural number 1~L. $E_i$ is given by formula $$E_i = \sum_{n \in A_i} x_n^2,$$

where $A_i$ indicates a segment of the input frame. The module for calculating average energy of an input frame 12 calculates the average energy $E_0$ for each segment of the current input frame. The calculation formula is $$E_0 = \frac{1}{L}\sum_{i=1}^{L} E_i.$$

The multiplying parameter calculating module 14 calculates a multiplying parameter $\lambda_i$ corresponding to each segment of the input frame. The calculation formula is $\lambda_i$=r(bitrate)*$E_0/E_i$, where i is a natural number between 1~L and r(bitrate) is a bit rate related function. The form of the function r(bitrate) may refer to the table depicted in the above embodiment, which is omitted herein for brevity. The multiplying parameter transport module 15 sends these multiplying parameters to a code stream for transportation. The scaling module 16 multiplies the sampling points of all the segments of the input frame by the multiplying parameter $\lambda_i$ so that processed sampling points $x_1', x_2', \ldots, x_N'$ are obtained. The scaling formula is $x_n'=x_n\lambda_i, x_n \in \{x_{l_{i-1}+1}, x_{l_{i-1}+2}, \ldots, x_{l_i}\}$. The time-frequency transformation and coding module 17 performs time-frequency transformation and coding on the processed sampling points $x_1', x_2', \ldots, x_N'$ and outputs to the code stream.

Figure 2:
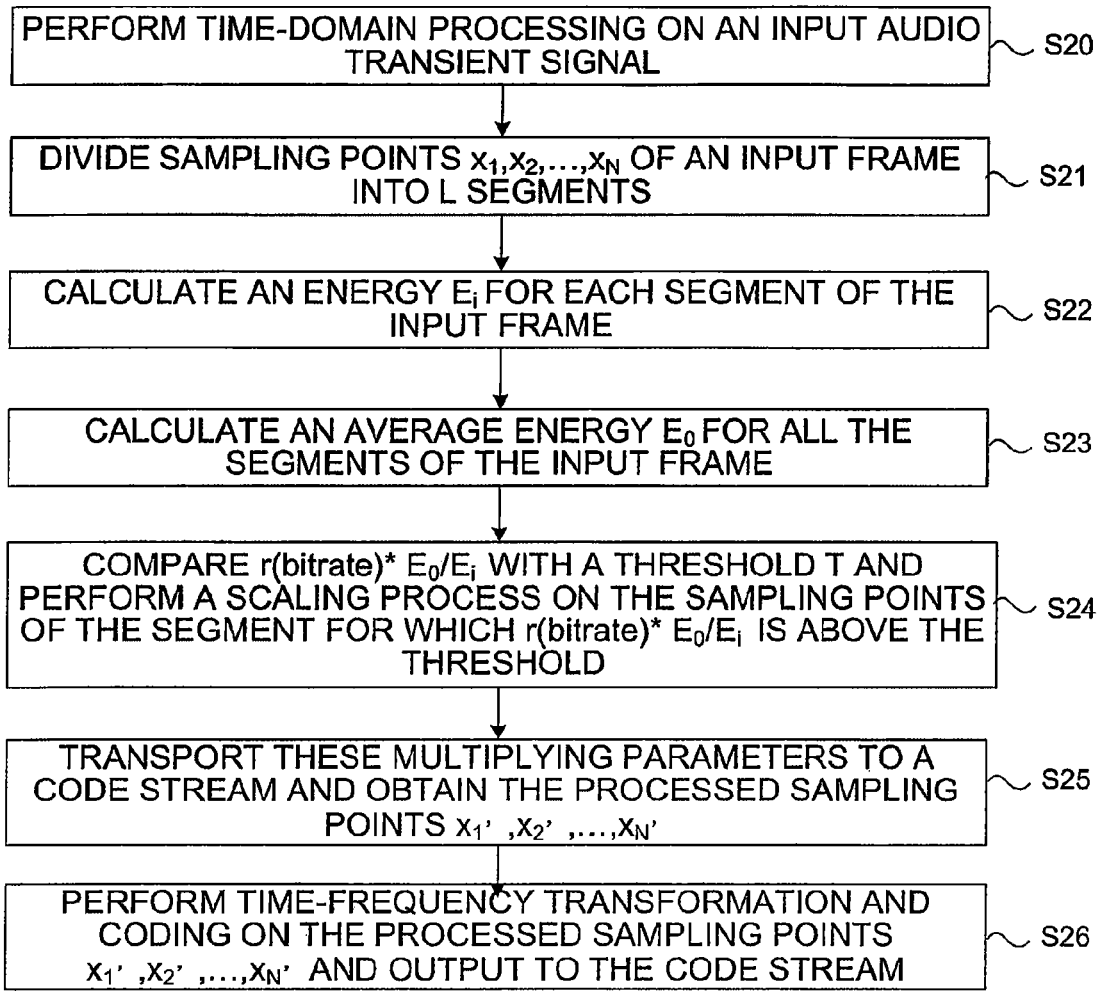
FIG. 2 is a flow diagram of an audio encoding method according to another preferred embodiment of the present invention.

FIG. 2 is a flow diagram of an audio encoding method according to another preferred embodiment of the present invention. Each step is detailed below with reference to FIG. 2.

At step S20, an input audio transient signal is processed in time domain. This is a traditional signal processing step, including designing filter sets, controlling gain, selecting long and short windows, etc.

At step S21, sampling points $x_1, x_2, \ldots, x_N$ of an input frame are divided into L segments, where N is the length of the input frame and L is an arbitrary natural number less than or equal to N. These sampling points $x_1, x_2, \ldots, x_N$ are divided into $$\{x_{l_0}, x_{l_0+1}, \ldots, x_{l_1}\}, \{x_{l_1+1}, x_{l_1+2}, \ldots, x_{l_2}\}, \ldots, \{x_{l_{L-1}+1}, x_{l_{L-1}+2}, \ldots, x_{l_L}\},$$

where $l_0=1, l_L=N$.

There are various methods for segmentation. All sampling points can be evenly divided into 32 segments. Alternatively, all sampling points can be evenly divided into 16 segments. Or, all the sampling points can be divided into several even or uneven segments according to the position where transient effect takes place.

At step S22, the energy $E_i$ for each segment of the input frame is calculated, where i is a natural number between 1~L. The calculation formula is $$E_i = \sum_{n \in A_i} x_n^2,$$

where $A_i$ indicates a segment of the input frame.

At step S23, an average energy $E_0$ for all the segments of the input frame is computed. The calculation formula is given by $$E_0 = \frac{1}{L}\sum_{i=1}^{L} E_i.$$

At step S24, for each segment $A_i$ of the input frame, the product of the bit rate related function r(bitrate) and $E_0/E_i$ is compared with a threshold T, i.e., r(bitrate)*$E_0/E_i$ is compared with the threshold T.

For segment $A_i$ for which the product is less than the threshold T, the sampling points of this segment is multiplied with the multiplying parameter $\lambda_i$, where $\lambda_i$=r(bitrate)*$E_0/E_i$. That is, scalability is performed on some segment $A_i$, i.e., $x_n'=x_n\lambda_i$, $x_n \in \{x_{l_{i-1}+1}, x_{l_{i-1}+2}, \ldots, x_{l_i}\}$. However, the sampling points of other segments are not scaled.

The threshold T is pre-determined and arbitrary, and function r(bitrate) is a bit rate related function. Different bit rate results in different value of the function. The details may refer to the table depicted the first embodiment, which is omitted herein for brevity.

At step S25, these multiplying parameters are transported to the code stream and the processed sampling points $x_1', x_2', \ldots, x_N'$ are thus obtained.

At step S26, the processed sampling points $x_1', x_2', \ldots, x_N'$ are output to the code stream after time-frequency coding and transformation.

Figure 5:
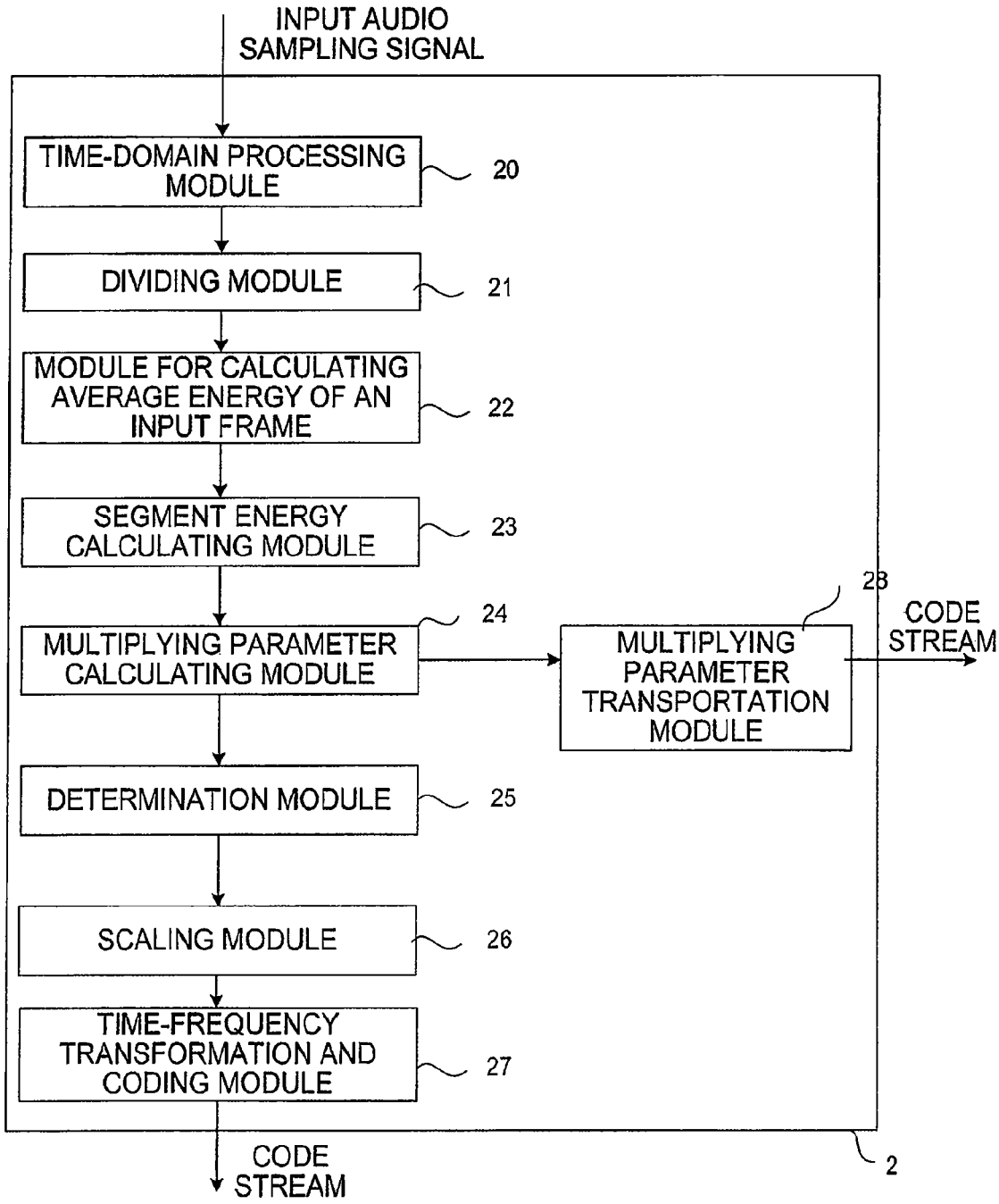
FIG. 5 is a block diagram of an audio encoding apparatus according to another preferred embodiment of the present invention.
Figure 6:
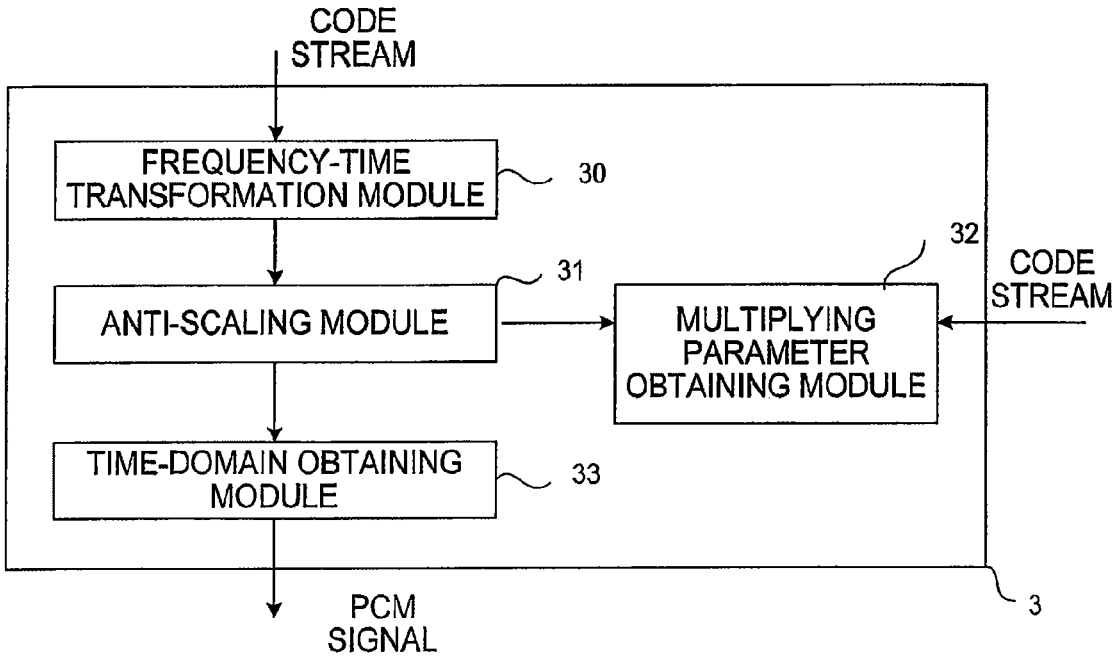
FIG. 6 is a block diagram of an audio decoding apparatus according to a preferred embodiment of the present invention.

Based on the above method, an audio encoding apparatus is also provided according to the present invention, as illustrated in FIG. 5. The audio encoding apparatus 2 includes a time-domain processing module 20, a dividing module 21, a module for calculating average energy of an input frame 22, a segment energy calculating module 23, a multiplying parameter calculating module 24, a determination module 25, a scaling module 26, a time-frequency transformation and coding module 27 and a multiplying parameter transportation module 28.

The time-domain processing module 20 processes the input audio transient signal in time domain and obtains a new time-domain signal. The time-domain processing module 20 includes traditional filter sets, a gain control module, a long-and-short window selecting module, etc. The dividing module 21 divides sampling points $x_1, x_2, \ldots, x_N$ of an input frame into L segments, where N is the length of the input frame and L is an arbitrary natural number less than or equal to N. These sampling points $x_1, x_2, \ldots, x_N$ are divided into $$\{x_{l_0}, x_{l_0+1}, \ldots, x_{l_1}\}, \{x_{l_1+1}, x_{l_1+2}, \ldots, x_{l_2}\}, \ldots, \{x_{l_{L-1}+1}, x_{l_{L-1}+2}, \ldots, x_{l_L}\},$$

where $l_0=1, l_L=N$. There are various methods for segmentation. All sampling points can be evenly divided into 32 segments. Alternatively, all sampling points can be evenly divided into 16 segments. Or, all the sampling points can be divided into several even or uneven segments according to the position where a transient effect takes place.

The segment energy calculating module 23 calculates the energy $E_i$ for each segment of the input frame, where i is a natural number 1~L. $E_i$ is given by $$E_i = \sum_{n \in A_i} x_n^2,$$

where $A_i$ indicates a segment of the input frame. The module for calculating average energy of an input frame 22 calculates the average energy $E_0$ for all the segments of the input frame. The calculation formula is $$E_0 = \frac{1}{L}\sum_{i=1}^{L} E_i.$$

The multiplying parameter calculating module 24 calculates a multiplying parameter $\lambda_i$ corresponding to each segment of the input frame. The calculation formula is $\lambda_i$=r(bitrate)*$E_0/E_i$, where i is a natural number between 1~L and r(bitrate) is a bit rate related function. A different bit rate results in a different value of the function. The details may refer to the table depicted the first embodiment, which is omitted herein for brevity. The multiplying parameter transport module 28 transports these multiplying parameters to a code stream.

For each segment $A_i$ of the input frame, the determination module 25 compares the product of the bit rate related function r(bitrate) and $E_0/E_i$ with a threshold T, i.e., r(bitrate)*$E_0/E_i$ is compared with T. For a segment for which the product is less than T, the scaling module 26 multiplies the sampling points of this segment with a corresponding multiplying parameter $\lambda_i$, where $\lambda_i$=r(bitrate)*$E_0/E_i$. That is, scalability is performed on some segment $A_i$, i.e., $x_n'=x_n\lambda_i, x_n \in \{x_{l_{i-1}+1}, x_{l_{i-1}+2}, \ldots, x_{l_i}\}$. The time-frequency transformation and coding module 27 performs time-frequency transformation and coding on the processed sampling points $x_1', x_2', \ldots, x_N'$ and outputs to the code stream.

Figure 3:
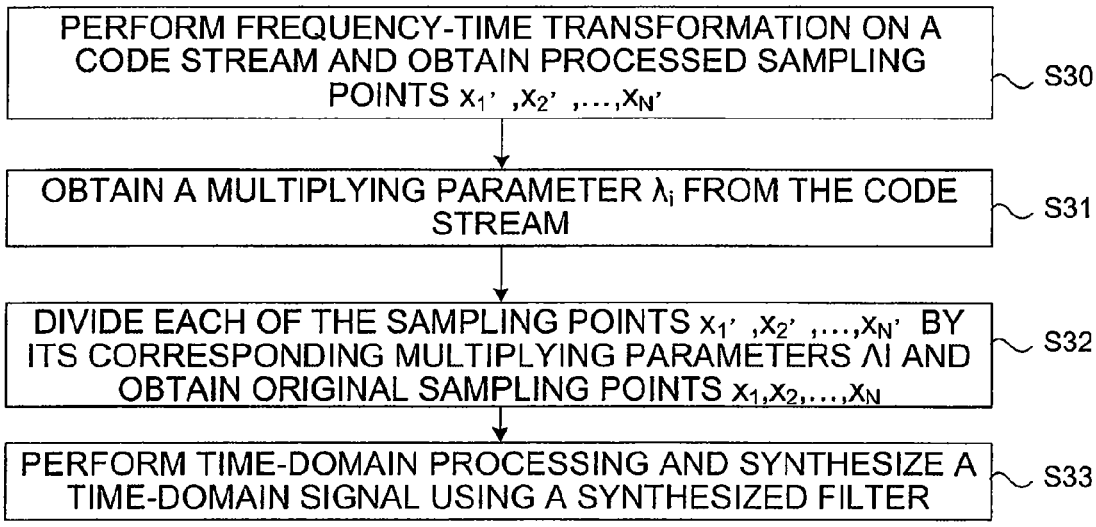
FIG. 3 is a flow diagram of an audio decoding method according to a preferred embodiment of the present invention.

Based on the encoding method of the above embodiment, a decoding method corresponding to the encoding method is proposed by the present invention. Each step in the decoding method according to a preferred embodiment is detailed below with reference to FIG. 3.

At step S30, time-frequency transformation is performed on a code stream and the processed sampling points $x_1', x_2', \ldots, x_N'$ are obtained. This step is an inverse step of S26 in FIG. 2.

At step S31, the multiplying parameter $\lambda_i$ is obtained from the code stream.

At step S32, the sampling points $x_1', x_2', \ldots, x_N'$ are divided by their corresponding multiplying parameters $\lambda_i$ and original sampling points $x_1, x_2, \ldots, x_N$ are thus obtained. That is, each segment is processed in the following way:

$$x_n = \frac{x_n'}{\lambda_i},\ x_n' \in \{x_{l_{i-1}+1}', x_{l_{i-1}+2}', \ldots, x_{l_i}'\}.$$

In fact, such step is an inverse process of step S15 or S24 in the embodiment where encoding is described.

At step S33, time domain processing is performed and a synthesized filter is employed to synthesize the signal in time domain. This step is an inverse process of step S10 or S20 in the embodiment where encoding is described.

Based on the above method, an audio decoding apparatus is provided according to the present invention. As illustrated in FIG. 5, the audio decoding apparatus 6 includes a frequency-time transformation module 30, an anti-scaling module 31, a multiplying parameter obtaining module 32 and a time-domain processing module 33. The frequency-time transformation module 30 performs a frequency-time transformation on a code stream to obtain sampling points $x_1', x_2', \ldots, x_N'$. The multiplying parameter obtaining module 32 obtains the multiplying parameter $\lambda_i$ from the code stream. Then anti-scaling module 31 divides each of the sampling points $x_1', x_2', \ldots, x_N'$ by its corresponding multiplying parameters $\lambda_i$ and obtains the original sampling points $x_1, x_2, \ldots, x_N$. The time-domain processing module 33 performs time-domain processing on the sampling points and synthesizes the time-domain signals.

The foregoing embodiments are provided to those skilled in the art for implementation or usage of the present disclosure. Various modifications or alternations may be made by those skilled in the art without departing from the spirit of the present disclosure. Therefore, the foregoing embodiments shall not be construed to be limiting to the scope of present disclosure. Rather, the scope of the present disclosure should be construed as the largest scope in accordance with inventive features as recited in the claims.

What is claimed is:

1. An audio encoding method for encoding a transient signal, comprising:

performing time-domain processing on an input audio transient signal and obtaining a new time-domain signal by an audio processing apparatus;

dividing sampling points $x_1, x_2, \ldots, x_N$ of an input frame into L segments, where N is the length of the input frame and L is an arbitrary natural number less than or equal to N by the audio processing apparatus;

calculating an energy $E_i$ for each segment, where i is a natural number between 1~L by the audio processing apparatus;

calculating an average energy $E_0$ for each segment of the input frame by the audio processing apparatus;

calculating a multiplying parameter $\lambda_i$ corresponding to each segment by virtue of $\lambda_i$=r(bitrate)*$E_0/E_i$ by the audio processing apparatus, where i is a natural number between 1~L and r(bitrate) is a bit rate related function, $E_0$ is defined as an average energy for segments i from 1 to L of an input frame, and $E_i$ is defined as an energy for a given segment of the input frame;

multiplying the sampling points of all the segments of the input frame by corresponding multiplying parameter $\lambda_i$, obtaining the processed sampling points $x_1', x_2', \ldots, x_N'$; and sending the multiplying parameter $\lambda_i$ to a code stream for transportation by the audio processing apparatus; and performing time-frequency transformation and coding on the processed sampling points $x_i', x_2', \ldots, x_N'$ and outputting to the code stream by the audio processing apparatus.

2. The audio encoding method of claim 1, characterized in that, the sampling points $x_1, x_2, \ldots, x_N$ of the input frame are divided evenly into 32 segments by the audio processing apparatus.

3. The audio encoding method of claim 1, characterized in that, the sampling points $x_1, x_2, \ldots, x_N$ of the input frame are divided evenly into 16 segments by the audio processing apparatus.

4. The audio encoding method of claim 1, characterized in that, the sampling points $x_1, x_2, \ldots, x_N$ of the input frame are divided into a plurality of even or uneven segments according to a position where transient effect takes place, by the audio processing apparatus.

5. The audio encoding method of claim 1, characterized in that, the formula for calculating the energy for each segment by the audio processing apparatus is $$E_i = \sum_{n \in A_i} x_n^2,$$

where $A_i$ indicates a segment of the input frame.

6. The audio encoding method of claim 5, characterized in that, the formula for calculating the average energy for the current input frame by the audio processing apparatus is $$E_0 = \frac{1}{L}\sum_{i=1}^{L} E_i.$$

7. The audio encoding method of claim 1, characterized in that, bit rate BR in the bit rate related function r(bitrate) is a variable, wherein the variable BR refers to an average bit rate of an audio channel; when BR<35 k, the value of function is 15.0; when 35 k≦BR<37.5 k, the value of function is 10.0; when 37.5 k≦BR<40 k, the value of function is 8.5; when 40 k≦BR<42.5 k, the value of function is 7.0; when 42.5 k≦BR<45 k, the value of function is 6.0; when 45 k≦BR<47.5 k, the value of function is 4.8; when 47.5 k≦BR<50 k, the value of function is 3.9; when 50 k≦BR<52.5 k, the value of function is 3.6; when 52.5 k≦BR<55 k, the value of function is 3.4; when 55 k≦BR<57.5 k, the value of function is 2.2; when 57.5 k≦BR<60 k, the value of function is 1.5; when 60 k≦BR<62.5 k, the value of function is 1.2; when BR≧62.5 k, the value of function is 1.1.

8. An audio encoding method for encoding a transient signal, comprising:

performing time-domain processing on an input audio transient signal by a an audio processing apparatus;

dividing sampling points $x_1, x_2, \ldots, x_N$ of an input frame into L segments, where N is the length of the input frame and L is an arbitrary natural number less than or equal to N by the audio processing apparatus;

calculating an energy $E_i$ for each segment, where i is a natural number between 1~L by the audio processing apparatus;

calculating an average energy $E_0$ for each segment of the input frame by the audio processing apparatus;

for each segment of the input frame, comparing a product of a bit related function r and $E_0/E_i$ with a threshold T by the audio processing apparatus;

for segment $A_i$ for which the product is less than the threshold T, multiplying the sampling points of the segment by the corresponding multiplying parameter $\lambda_i$, where $\lambda_i$=r(bitrate)*$E_0/E_i$, where $E_0$ is defined as an average energy for segments i from 1 to L of an input frame, and $E_i$ is defined as an energy for a given segment of the input frame;

transporting these multiplying parameters to a code stream and obtaining the processed sampling points $x_1'$, $x_2'$, . . . , $x_N'$ by the audio processing apparatus; and performing time-frequency transformation and coding on the processed sampling points $x_1', x_2', \ldots, x_N'$ and outputting to the code stream by the audio processing apparatus.

9. The audio encoding method of claim 8, characterized in that, the sampling points $x_1, x_2, \ldots, x_N$ of the input frame are divided evenly into 32 segments by the audio processing apparatus.

10. The audio encoding method of claim 8, characterized in that, the sampling points $x_1, x_2, \ldots, x_N$ of the input frame are divided evenly into 16 segments by the audio processing apparatus.

11. The audio encoding method of claim 8, characterized in that, the sampling points $x_1, x_2, \ldots, x_N$ of the input frame are divided into a plurality of even or uneven segments according to a position where transient effect takes place by the audio processing apparatus.

12. The audio encoding method of claim 8, characterized in that, the formula for calculating the energy for each segment by the audio processing apparatus is $$E_i = \sum_{n \in A_i} x_n^2,$$

where $A_i$ indicates a segment of the input frame.

13. The audio encoding method of claim 12, characterized in that, the formula for calculating an average energy for each segment of the input frame by the audio processing apparatus is $$E_0 = \frac{1}{L}\sum_{i=1}^{L} E_i.$$

14. The audio encoding method of claim 8, characterized in that, the threshold T is predetermined.

15. The audio encoding method of claim 8, characterized in that, bit rate BR in the bit rate related function r(bitrate) is a variable, wherein the variable BR refers to an average bit rate of an audio channel; when BR<35 k, the value of function is 15.0; when 35 k≦BR<37.5 k, the value of function is 10.0; when 37.5 k≦BR<40 k, the value of function is 8.5; when 40 k≦BR<42.5 k, the value of function is 7.0; when 42.5 k≦BR<45 k, the value of function is 6.0; when 45 k≦BR<47.5 k, the value of function is 4.8; when 47.5 k≦BR<50 k, the value of function is 3.9; when 50 k≦BR<52.5 k, the value of function is 3.6; when 52.5 k≦BR<55 k, the value of function is 3.4; when 55 k≦BR<57.5 k, the value of function is 2.2; when 57.5 k≦BR<60 k, the value of function is 1.5; when 60 k≦BR<62.5 k, the value of function is 1.2; when BR≧62.5 k, the value of function is 1.1.

16. An audio decoding method for decoding a transient signal, comprising:

performing frequency-time transformation on a code stream and obtaining processed sampling points $x_1'$, $x_2'$, . . . , $x_N'$ by an audio processing apparatus;

obtaining a multiplying parameter $\lambda_i$ corresponding to each segment by virtue of $\lambda_i$=r(bitrate)*$E_0/E_i$ from the code stream by the audio processing apparatus, where i is a natural number between 1~L and r(bitrate) is a bit rate related function, where $E_0$ is defined as an average energy for segments i from 1 to L of an input frame, and $E_i$ is defined as an energy for a given segment of the input frame;

dividing each of the sampling points $x_1', x_2', \ldots, x_N'$ by its corresponding multiplying parameters $\lambda_i$ and obtaining original sampling points $x_1, x_2, \ldots, x_N$ by audio processing apparatus; and performing time-domain processing and synthesizing a time-domain signal by the audio processing apparatus.

17. An audio encoding apparatus for encoding a transient signal, comprising:

a time-domain processing module, configured to perform time-domain processing on an input audio transient signal and obtain a new time-domain signal by an audio processing apparatus;

a dividing module, configured to divide sampling points $x_1, x_2, \ldots, x_N$ of an input frame into L segments, where N is the length of the input frame and L is an arbitrary natural number less than or equal to N by the audio processing apparatus;

a segment energy calculating module, configured to calculate an energy $E_i$ for each segment, where i is a natural number between 1~L by the audio processing apparatus;

a module for calculating average energy of an input frame, configured to calculate the average energy $E_0$ for each segment of the input frame by using the processor;

a multiplying parameter calculating module, configured to calculate a multiplying parameter $\lambda_i$ corresponding to each segment by virtue of $\lambda_1$=r(bitrate)*$E_0/E_i$ by the audio processing apparatus, where i is a natural number between 1~L and r(bitrate) is a bit rate related function, $E_0$ is defined as an average energy for segments i from 1 to L of an input frame, and $E_i$ is defined as an energy for a given segment of the input frame;

a scaling module, configured to multiply the sampling points of all the segments of the input frame by a corresponding multiplying parameter $\lambda_i$ and obtain processed sampling points $x_1', x_2', \ldots, x_N'$ by the audio processing apparatus;

a multiplying parameter transport module, configured to send the multiplying parameters $\lambda_i$ to a code stream for transportation by the audio processing apparatus; and a time-frequency transformation and coding module, configured to perform time-frequency transformation and coding on the processed sampling points $x_1', x_2', \ldots, x_N'$ and output to the code stream by the audio processing apparatus.

18. The audio encoding apparatus of claim 17, characterized in that, the dividing module evenly divides the sampling points $x_1, x_2, \ldots, x_N$ of the input frame into 32 segments by the audio processing apparatus.

19. The audio encoding apparatus of claim 17, characterized in that, the dividing module evenly divides the sampling points $x_1, x_2, \ldots, x_N$ of the input frame into 16 segments by the audio processing apparatus.

20. The audio encoding apparatus of claim 17, characterized in that, the dividing module divides the sampling points $x_1, x_2, \ldots, x_N$ of the input frame into a plurality of even or uneven segments according to a position where transient effect takes place by the audio processing apparatus.

21. The audio encoding apparatus of claim 17, characterized in that, the segment energy calculating module calculates the energy for each segment using the formula $$E_i = \sum_{n \in A_i} x_n^2,$$

where $A_i$ indicates a segment of the input frame, by the audio processing apparatus.

22. The audio encoding apparatus of claim 21, characterized in that, the module for calculating average energy of an input frame calculates the average energy of an input frame using a formula $$E_0 = \frac{1}{L}\sum_{i=1}^{L} E_i,$$

by the audio processing apparatus.

23. The audio encoding apparatus of claim 17, characterized in that, bit rate BR in the bit rate related function r(bitrate) is a variable, wherein the variable BR refers to an average bit rate of an audio channel; when BR<35 k, the value of function is 15.0; when 35 k≦BR<37.5 k, the value of function is 10.0; when 37.5 k≦BR<40 k, the value of function is 8.5; when 40 k≦BR<42.5 k, the value of function is 7.0; when 42.5 k≦BR<45 k, the value of function is 6.0; when 45 k≦BR<47.5 k, the value of function is 4.8; when 47.5 k≦BR<50 k, the value of function is 3.9; when 50 k≦BR<52.5 k, the value of function is 3.6; when 52.5 k≦BR<55 k, the value of function is 3.4; when 55 k≦BR<57.5 k, the value of function is 2.2; when 57.5 k≦BR<60 k, the value of function is 1.5; when 60 k≦BR<62.5 k, the value of function is 1.2; when BR≧62.5 k, the value of function is 1.1.

24. An audio encoding apparatus for encoding a transient signal, comprising:

a time-domain processing module, configured to perform time-domain processing on an input audio transient signal and obtain a new time-domain signal by an audio processing apparatus;

a dividing module, configured to divide sampling points $x_1, x_2, \ldots, x_N$ of an input frame into L segments, where N is the length of the input frame and L is an arbitrary natural number less than or equal to N by the audio processing apparatus;

a segment energy calculating module, configured to calculate an energy $E_i$ for each segment, where i is a natural number between 1~L by the audio processing apparatus;

a module for calculating average energy of an input frame, configured to calculate the average energy $E_0$ for each segment of the input frame by the audio processing apparatus;

a multiplying parameter calculating module, configured to calculate a multiplying parameter $\lambda_i$ corresponding to each segment by virtue of $\lambda_i$=r(bitrate)*$E_0/E_i$ by an audio processing apparatus, where i is a natural number between 1~L and r(bitrate) is a bit rate related function, $E_0$ is defined as an average energy for segments i from 1 to L of an input frame, and $E_i$ is defined as an energy for a given segment of the input frame;

a determination module, configured to compare a product of the bit related function r(bitrate) and $E_0/E_i$ with a threshold T for each segment of the input frame by the audio processing apparatus;

a scaling module, configured to multiply the sampling points of a segment $A_i$ for which the product is less than the threshold T by a corresponding multiplying parameter $\lambda_i$ and obtain processed sampling points $x_1', x_2', \ldots, x_N'$ by the audio processing apparatus;

a multiplying parameter transport module, configured to transport the multiplying parameters $\lambda_i$ to a code stream by the audio processing apparatus; and a time-frequency transformation and coding module, configured to perform time-frequency transformation and coding on the processed sampling points $x_1', x_2', \ldots, x_N'$ and output to the code stream by the audio processing apparatus.

25. The audio encoding apparatus of claim 24, characterized in that, the dividing module evenly divides the sampling points $x_1, x_2, \ldots, x_N$ of the input frame into 32 segments by the audio processing apparatus.

26. The audio encoding apparatus of claim 24, characterized in that, the dividing module evenly divides the sampling points $x_1, x_2, \ldots, x_N$ of the input frame into 16 segments by the audio processing apparatus.

27. The audio encoding apparatus of claim 24, characterized in that, the dividing module divides the sampling points $x_1, x_2, \ldots, x_N$ of the input frame into a plurality of even or uneven segments according to a position where transient effect takes place by the audio processing apparatus.

28. The audio encoding apparatus of claim 24, characterized in that, the segment energy calculating module calculates the energy for each segment using a formula $$E_i = \sum_{n \in A_i} x_n^2,$$

where $A_i$ indicates a segment of the input frame by the audio processing apparatus.

29. The audio encoding apparatus of claim 28, characterized in that, the module for calculating average energy of an input frame calculates the average energy for each segment of the input frame using a formula $$E_0 = \frac{1}{L}\sum_{i=1}^{L} E_i$$

by the audio processing apparatus.

30. The audio encoding apparatus of claim 24, characterized in that, the threshold T for the determination module is predetermined.

31. The audio encoding apparatus of claim 24, characterized in that, bit rate BR of the bit rate related function r(bitrate) is a variable, wherein the variable BR refers to an average bit rate of an audio channel; when BR<35 k, the value of function is 15.0; when 35 k≦BR<37.5 k, the value of function is 10.0; when 37.5 k≦BR<40 k, the value of function is 8.5; when 40 k≦BR<42.5 k, the value of function is 7.0; when 42.5 k≦BR<45 k, the value of function is 6.0; when 45 k≦BR<47.5 k, the value of function is 4.8; when 47.5 k≦BR<50 k, the value of function is 3.9; when 50 k≦BR<52.5 k, the value of function is 3.6; when 52.5 k≦BR<55 k, the value of function is 3.4; when 55 k≦BR<57.5 k, the value of function is 2.2; when 57.5 k≦BR<60 k, the value of function is 1.5; when 60 k≦BR<62.5 k, the value of function is 1.2; when BR≧62.5 k, the value of function is 1.1.

32. An audio decoding apparatus for decoding a transient signal, comprising:

a frequency-time transformation module, configured to perform a frequency-time transformation on a code stream to obtain sampling points $x_1', x_2', \ldots, x_N'$ by an audio processing apparatus;

a multiplying parameter obtaining module, configured to obtain multiplying parameter $\lambda_i$ corresponding to each segment by virtue of $\lambda_i = r(\text{bitrate}) * E_0/E_i$ from the code stream by the audio processing apparatus, where i is a natural number between 1~L and r(bitrate) is a bit rate related function, where $E_0$ is defined as an average energy for segments i from 1 to L of an input frame, and $E_i$ is defined as an energy for a given segment of the input frame;

an anti-scaling module, configured to divide each of the sampling points $x_1', x_2', \ldots, x_N'$ by its corresponding multiplying parameters $\lambda_i$ and obtain original sampling points $x_1, x_2, \ldots, x_N$ by the audio processing apparatus; and a time-domain processing module, configured to perform time-domain processing on the sampling points and synthesize a time-domain signal by the audio processing apparatus.

* * * * *